US008506837B2

(12) United States Patent
Ocalan et al.

(10) Patent No.: US 8,506,837 B2
(45) Date of Patent: Aug. 13, 2013

(54) FIELD-RESPONSIVE FLUIDS

(75) Inventors: Murat Ocalan, Boston, MA (US); Huilin Tu, Cambridge, MA (US); Nathan Wicks, Somerville, MA (US); Agathe Robisson, Cambridge, MA (US); Dominique Guillot, Somerville, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 709 days.

(21) Appl. No.: 12/112,003

(22) Filed: Apr. 30, 2008

(65) Prior Publication Data

US 2009/0211751 A1 Aug. 27, 2009

Related U.S. Application Data

(60) Provisional application No. 61/030,733, filed on Feb. 22, 2008.

(51) Int. Cl.
*B32B 15/18* (2006.01)
*C04B 35/26* (2006.01)
*E21B 31/06* (2006.01)

(52) U.S. Cl.
USPC ..... 252/62.56; 252/62.52; 252/62.54; 428/692.1; 166/66.5; 166/387

(58) Field of Classification Search
USPC ..... 252/62.52, 62.51 R, 62.54, 62.55, 252/62.56; 166/66.5, 387; 428/692.1; 210/222, 210/223, 695
See application file for complete search history.

(56) References Cited

U.S. PATENT DOCUMENTS 5,277,281 A * 1/1994 Carlson et al. ..... 188/267
5,296,155 A 3/1994 Reitz (Continued)

FOREIGN PATENT DOCUMENTS

EP 0394049 A 10/1990
EP 1632962 A 3/2006
WO 2004107369 A1 12/2004

OTHER PUBLICATIONS

Simon et al., Estimation of the Effective Permeability in Magnetorheological Fluids, Oct. 23, 1998, pp. 1-15.*

(Continued)

*Primary Examiner* — David C Mellon
(74) *Attorney, Agent, or Firm* — Bridget Laffey; Rachel E. Greene; Jakub Michna

(57) ABSTRACT

A field-responsive fluid which enters a semi-solid state in the presence of an energy field is improved by use of a plurality of energy field responsive particles which form chains in response to the energy field. The particles can be (a) composite particles in which at least one field-responsive member having a first density is attached to at least one member having a second density that is lower than the first density, (b) shaped particles in which at least one field-responsive member has one or more inclusions, and (c) combinations thereof. The particles improve the field-responsive fluid by reducing density without eliminating field-responsive properties which afford utility. Further, a multi-phase base fluid including a mixture of two or more substances, at least two of which are immiscible, may be used. The multi-phase base fluid improves the field-responsive fluid because surface tension between the boundaries of the immiscible substances in conjunction with chains formed by field-responsive particles tends to stop or retard creep flow, resulting an improved dynamic or static seal.

29 Claims, 8 Drawing Sheets

U.S. PATENT DOCUMENTS

| | | | | |
|---|---|---|---|---|
| 5,445,760 | A | 8/1995 | Pollack | |
| 5,525,249 | A * | 6/1996 | Kordonsky et al. | 252/62.56 |
| 5,667,715 | A * | 9/1997 | Foister | 252/62.52 |
| 5,900,184 | A * | 5/1999 | Weiss et al. | 252/62.52 |
| 6,027,664 | A * | 2/2000 | Weiss et al. | 252/62.52 |
| 6,638,443 | B2 * | 10/2003 | Iyengar et al. | 252/62.52 |
| 7,007,972 | B1 * | 3/2006 | Radhakrishnan et al. | 280/736 |
| 2003/0025101 | A1 * | 2/2003 | Park et al. | 252/62.52 |
| 2004/0084651 | A1 * | 5/2004 | Kintz et al. | 252/62.52 |
| 2006/0231357 | A1 * | 10/2006 | Jolly et al. | 188/267.1 |
| 2006/0249705 | A1 * | 11/2006 | Wang et al. | 252/62.51 C |
| 2007/0252104 | A1 * | 11/2007 | Bose et al. | 252/62.54 |
| 2009/0039309 | A1 * | 2/2009 | Bose et al. | 252/62.55 |

OTHER PUBLICATIONS

Bizdoaca et al, "Magnetically directed self assembly of submicron spheres with a Fe3O4 nanoparticle shell", Journal of Magnetism and Magentic Materials 240 (2002), pp. 44-46.

Bizdoaca et al, "Self assembly and magnetism in core-shell microspheres", J. Vac. Sci. Technol. A 21(4), Jul./Aug. 2003, pp. 1515-1518.

Caruso et al, "Magnetic nanocomposite particles and hallow spheres constructed by a sequential layering approach", Chem. Mater. 2001, 13, pp. 109-116.

Choi et al, "Magnetorheology of synthesized core-shell structured nanoparticle", IEEE Transactions on Magnetics, vol. 41, No. 10, Oct. 2005, pp. 3448-3450.

Cong, et al, "A facile interfacial reaction route to prepare magnetic hollow spheres with tunable shell thickness", Langmuir 2008, 24, pp. 6624-6629.

Dinsmore et al, "Colloidosomes: Selectively permeable capsules composed of colloidal particles", Science, Reports, vol. 298, Nov. 2002, pp. 1006-1009.

Fang et al, "Polymeric nanobead coated carbonyl iron particles and their magnetic property", phys. stat. sol. (a) 204, No. 12, 2007, pp. 4190-4193.

Galindo-Gonzalex et al, "Stability of concentrated aqueous clay-magnetite suspensions", ScienceDirect, Colloids and Surfaces A: Physicochem. Eng. Aspects 306 (2007) pp. 150-157.

Jiang et al, "A simple route to synthesize ZnFe2O4 hollow spheres and their magnetorheological characteristics", Smart Materials and Structures, 18 (2009) 4 pages.

Jun et al, "Synthesis and characterization of monodisperse magnetic composite particles for magnetorheological fluid materials" Colloids and Surfaces A: Colloids and Surfaces A: Physiochem. Eng. Aspects 260 (2005) pp. 157-164.

Lee et al, "Novel carbonyl iron/polystyrene (CI/PS) composites synthesized via solvent casting and their magnetorheology", phys. stat. sol. (a) 204, No. 12, (2007) pp. 4186-4189.

Liu et al, "A simple approach to the synthesis of hollow microspheres with magnetite/silica hybrid walls", Journal of Colloid and Interface Science, 333 (2009) pp. 329-334.

Noble et al, "Fabrication of "Hairy" Colloidosomes with Shells of Polymeric Microrods", Journal of the American Chemical Society, vol. 126, 2004, pp. 8092-8093.

Park et al, "Rheological properties and stabilization of magnetorheological fluids in a water-in-oil emulsion", Journal of Colloid and Interface Science, vol. 240, 2001, pp. 349-354.

Pu et al, "Preparation and properties of soft magnetic particles based on Fe3O4 and hollow polystyrene microsphere composite", ScienceDirect, Materials Chemistry and Physics 100 (2006) pp. 10-14.

Pu et al, "Towards high sedimentation stability: magnetorheological fluids based on CNT/Fe3O4 nanocomposites", Institute of Physics Publishing, Nanotechnology 16, (2005) pp. 1486-1489.

Singh et al, "Orientational dependence of apparent magnetic susceptibilities of superparamagnetic nanoparticles in planar structured arrays: Effect on magnetic moments of nanoparticle-coated coar-shell magnetic beads" ScienceDirect, Journal of Magnetism and Magnetic Materials 315 (2007) pp. 53-64.

Singh et al, "Rigid, superparamagnetic chains of permanently linked beads coated with magnetic nanoparticles. Synthesis and rotational dynamics under applied magnetic fields", Langmuir 2005, 21, pp. 11500-11509.

Deshmukh, Suraj Sharadchandra, "Development, characterization and applications of magnetorheological fluid based "smart" materials on the macro-to-micro scale", Massachusetts Institute of Technology, MIT Theses, URI: http://hdl.handle.net/1721.1/38697, Issue Date 2007, Date Accessed Jun. 15, 2010, 3 pages.

* cited by examiner

FIELD-RESPONSIVE FLUIDS

CROSS REFERENCE TO RELATED APPLICATION(S)

This application is related to and claims priority to Provisional Application No. 61/030,733,filed on Feb. 22, 2008 which is herein incorporated by reference in its entirety.

FIELD OF THE INVENTION

This invention is generally related to field-responsive fluids, and more particularly to magnetorheological and electrorheological fluids with enhanced properties such as low density creep flow resistance.

BACKGROUND OF THE INVENTION

Magnetorheological fluids typically comprise magnetically responsive particles suspended in a base fluid. A third element, known as an additive, may also be included to assist in suspending the particles and preventing agglomeration. In the absence of a magnetic field, the magnetorheological fluid behaves similar to a Newtonian fluid. However, in the presence of a magnetic field the particles suspended in the base fluid align and form chains which are roughly parallel to the magnetic lines of flux associated with the field. Further, the magnetic field causes the fluid to enter a semi-solid state which exhibits increased resistance to shear. Resistance to shear is increased due to the magnetic attraction between particles of the chains. Adjacent chains of particles combine to form a sealing wall. The effect induced by the magnetic field is both reversible and repeatable. Electrorheological fluids are analogous, although responsive to an electric field rather than a magnetic field. However, field-responsive fluids have some drawbacks.

The use of field-responsive fluids in long fluid columns such as those found in wellbores can cause problems because the specific gravity of fluid is typically higher than commonly used fluids and for magnetorheological fluids on the order of 3-4. As a result, the hydrostatic pressure exerted at lower sections of the long fluid column can reach values great enough to damage equipment and completion. One reason for the relatively great specific gravity of magnetorheological fluids is that the magnetic properties which enable the field-responsive particles to function are found in materials having relatively higher densities than many fluids, e.g., iron and nickel. Some examples of magnetorheological particle technology known in the art include a method of manufacturing shaped magnetic particles published in Deshmukh, S.S., "Development, characterization and applications of magnetorheological fluid based 'smart' materials on the macro-to-micro scale," MIT PhD Thesis, 2007; and polymer coated magnetic beads sold under the trade name DYNABEADS® by Invitrogen Corporation for cell separation and expansion applications.

Another drawback of field-responsive fluids is susceptibility to creep flow. Creep flow refers to the tendency of fluid to traverse the chains of particles by passing through spaces between particles. For example, a magnetorheological fluid shaft seal utilizes a magnetic field supplied between two segments of a housing structure to cause the fluid to form a semi-solid seal in the gaps between the housing and shaft. This seal functions whether or not the shaft is rotating, and also exhibits shear resistance which can counter differential pressure, i.e., pressure inside the housing versus pressure outside the housing. However, differential pressure may still cause fluid creep through the spaces between magnetically responsive particles. In other words, even if the magnetic forces are sufficient to resist the shearing force due to differential pressure load, the base fluid is free to flow through the crevices between magnetorheological particles. This can lead to an undesirable case where fluid loss or gain occurs in the chamber that is to be sealed. Park, J. H, Chin, B. D., and Park, O. O., "Rheological Properties and Stabilization of Magnetorheological Fluids in a Water-in-Oil Emulsion," Journal of Colloid and Interface Science 240, 349-354, 2001,describes shear properties of a magnetorheological fluid with a water-in-oil emulsion base.

SUMMARY OF THE INVENTION

In accordance with an embodiment of the invention, apparatus for causing a fluid to enter a semi-solid state in the presence of an energy field comprises: a plurality of energy field responsive particles which form chains in response to the energy field, the particles selected from the group including: composite particles in which at least one field-responsive member having a first density is attached to at least one member having a second density that is lower than the first density; shaped particles in which at least one field-responsive member has one or more inclusions; and combinations thereof.

In accordance with another embodiment of the invention, a method for causing a fluid to enter a semi-solid state in a container in the presence of an energy field comprises: introducing a plurality of energy field responsive particles which form chains in response to the energy field, the particles selected from the group including: composite particles in which at least one field-responsive member having a first density is attached to at least one member having a second density that is lower than the first density; shaped particles in which at least one field-responsive member has one or more inclusions; and combinations thereof; and creating an energy field proximate to the particles.

An advantage of the invention is that the density of a field-responsive fluid can be reduced without eliminating field-responsive properties which afford utility. In particular, the density of the fluid can be reduced by reducing the density of field-responsive particles by utilizing composite particles in which at least one field-responsive member having a first density is attached to at least one member having a second density that is lower than the first density, or by utilizing shaped particles in which at least one field-responsive member has one or more inclusions, or by utilizing combinations thereof. The resulting particles remain field-responsive despite the use of inclusions or lower density non-field-responsive material. Such reduced density field-responsive fluids may have particular utility in long fluid columns such as those found in wellbores.

In accordance with another embodiment of the invention a multi-phase base fluid is utilized. The multi-phase base fluid is a mixture of two or more substances, at least two of which are immiscible, e.g., oil-water emulsion, foam. An advantage of multi-phase base fluids is that the surface tension between the boundaries of the immiscible substances in conjunction with the magnetically responsive particle chains tends to stop or retard creep flow, resulting an improved dynamic or static seal.

Further features and advantages of the invention will become more readily apparent from the following detailed description when taken in conjunction with the accompanying drawings.

DETAILED DESCRIPTION

Figure 1:
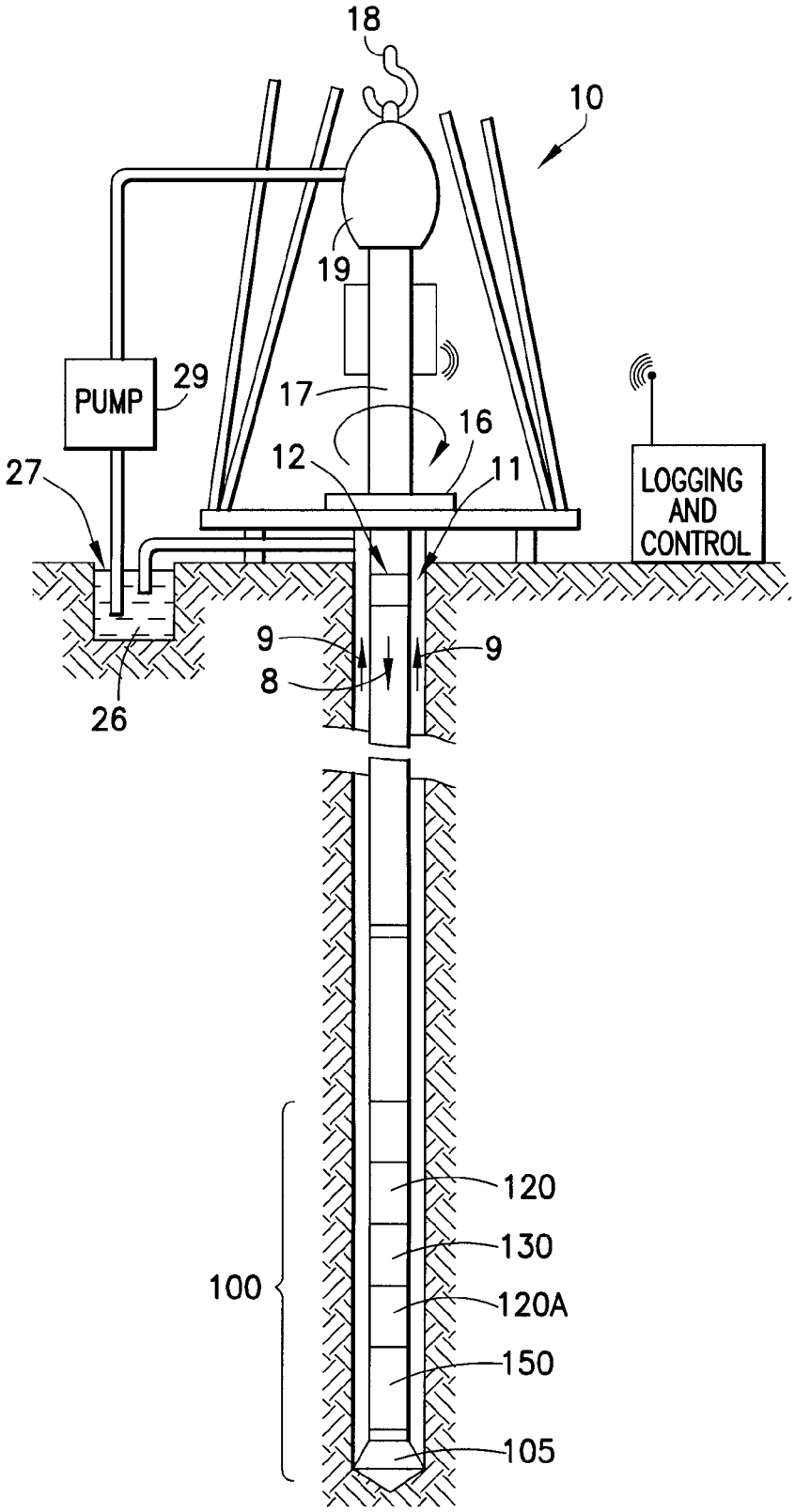
FIG. 1 illustrates a wellsite system in which the present invention can be employed.

FIG. 1 illustrates a wellsite system in which the present invention can be employed. The wellsite can be onshore or offshore. In this exemplary system, a borehole (11) is formed in subsurface formations by rotary drilling in a manner that is well known. Embodiments of the invention can also use directional drilling, as will be described hereinafter.

A drill string (12) is suspended within the borehole (11) and has a bottom hole assembly (100) which includes a drill bit (105) at its lower end. The surface system includes platform and derrick assembly (10) positioned over the borehole (11), the assembly (10) including a rotary table (16), kelly (17), hook (18) and rotary swivel (19). The drill string (12) is rotated by the rotary table (16), energized by means not shown, which engages the kelly (17) at the upper end of the drill string. The drill string (12) is suspended from a hook (18), attached to a traveling block (also not shown), through the kelly (17) and a rotary swivel (19) which permits rotation of the drill string relative to the hook. As is well known, a top drive system could alternatively be used.

In the example of this embodiment, the surface system further includes drilling fluid or mud (26) stored in a pit (27) formed at the well site. A pump (29) delivers the drilling fluid (26) to the interior of the drill string (12) via a port in the swivel (19), causing the drilling fluid to flow downwardly through the drill string (12) as indicated by the directional arrow (8). The drilling fluid exits the drill string (12) via ports in the drill bit (105), and then circulates upwardly through the annulus region between the outside of the drill string and the wall of the borehole, as indicated by the directional arrows (9). In this well known manner, the drilling fluid lubricates the drill bit (105) and carries formation cuttings up to the surface as it is returned to the pit (27) for recirculation.

The bottom hole assembly (100) of the illustrated embodiment includes a logging-while-drilling (LWD) module (120), a measuring-while-drilling (MWD) module (130), a roto-steerable system and motor (150), and drill bit (105).

The LWD module (120) is housed in a special type of drill collar, as is known in the art, and can contain one or a plurality of known types of logging tools. It will also be understood that more than one LWD and/or MWD module can be employed, e.g. as represented at (120A). (References, throughout, to a module at the position of (120) can alternatively mean a module at the position of (120A) as well.) The LWD module includes capabilities for measuring, processing, and storing information, as well as for communicating with the surface equipment. In the present embodiment, the LWD module includes a pressure measuring device.

The MWD module (130) is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

Figure 2:
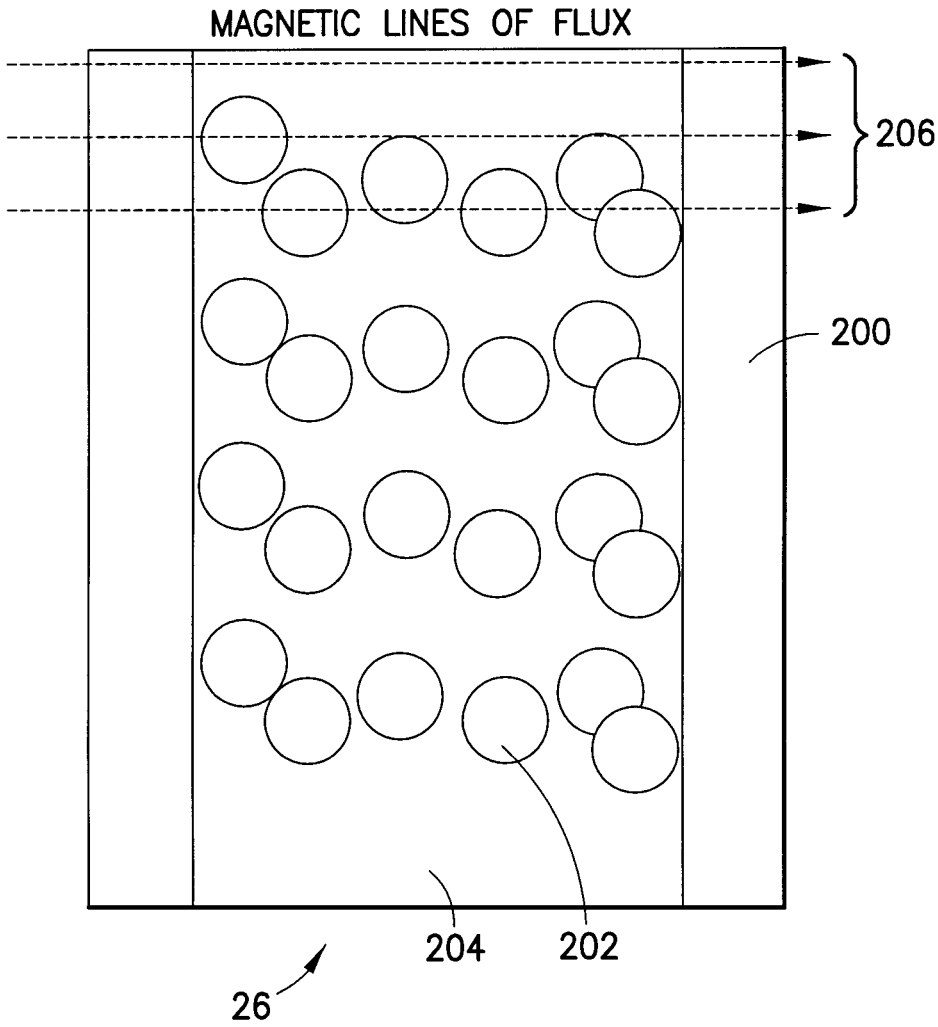
FIG. 2 illustrates the fluid of FIG. 1 in greater detail.

FIG. 2 illustrates operation of the fluid (26) within a conduit (200) such as drill string (12) of FIG. 1 in greater detail. The fluid (26) is a field-responsive fluid including magnetically or electrically responsive particles (202) suspended in a base fluid (204). An additive may also be included to assist in suspending the particles and preventing agglomeration. For clarity of explanation, a magnetorheological fluid will be described hereafter. In the absence of a magnetic field the magnetorheological fluid behaves similar to a Newtonian fluid. However, in the presence of magnetic field (206) the particles (202) suspended in the base fluid (204) align and form chains which are roughly parallel to the magnetic lines of flux associated with the magnetic field. When activated in this manner by a magnetic field, the magnetorheological fluid is in a semi-solid state which exhibits increased resistance to shear. In particular, resistance to shear is increased due to the magnetic attraction between particles of the chains.

Referring to FIGS. 2 through 11, the specific gravity of the magnetorheological fluid (26) is reduced by utilizing magnetically responsive particles characterized by lower density than known single-material, void-less magnetically responsive particles of equivalent volume. In particular, the reduction of density can be achieved by using one or more of composite magnetically responsive particles, shaped magnetically responsive particles, and low density magnetically non-responsive particles.

Figure 3:
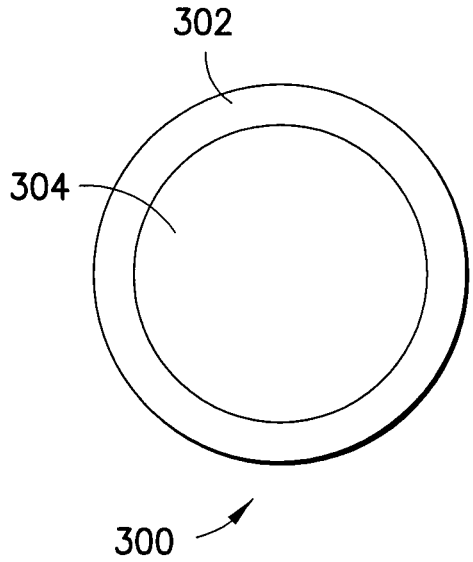
FIGS. 3 through 9 illustrate embodiments of composite particle geometries.
Figure 4:
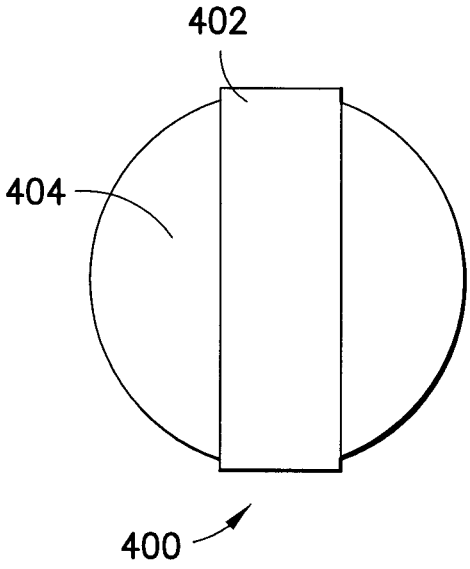
Figure 5:
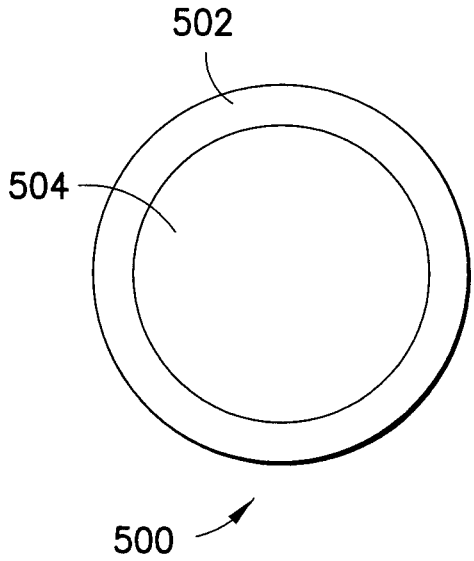
Figure 6:
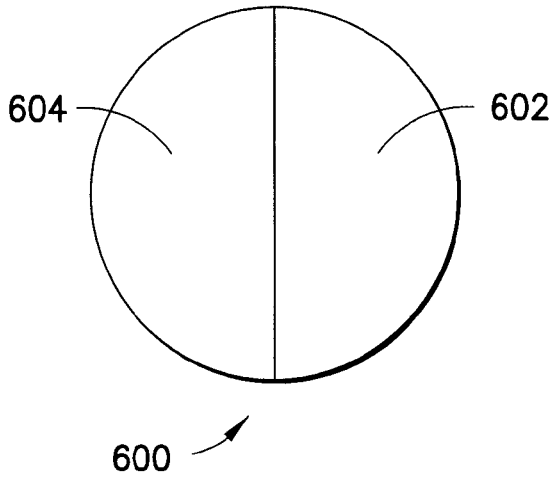
Figure 7:
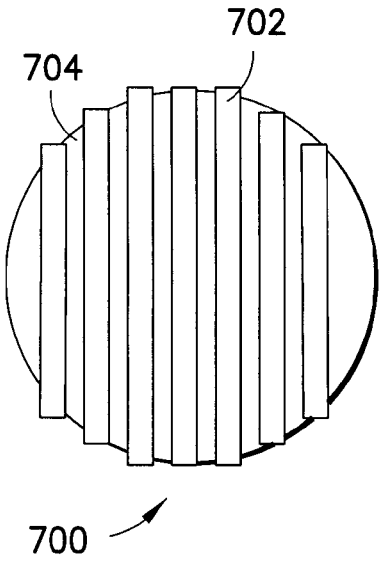
Figure 8:
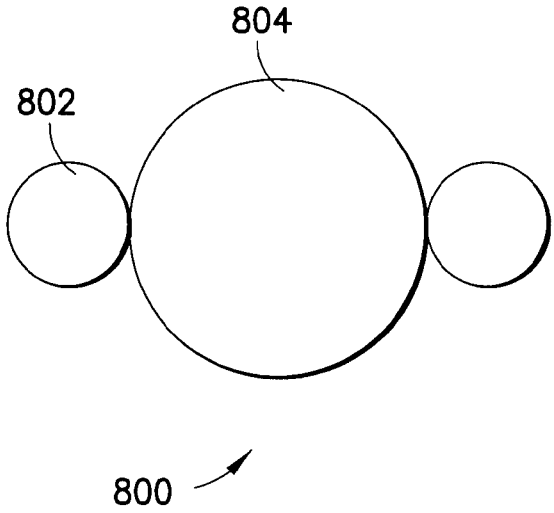
Figure 9:
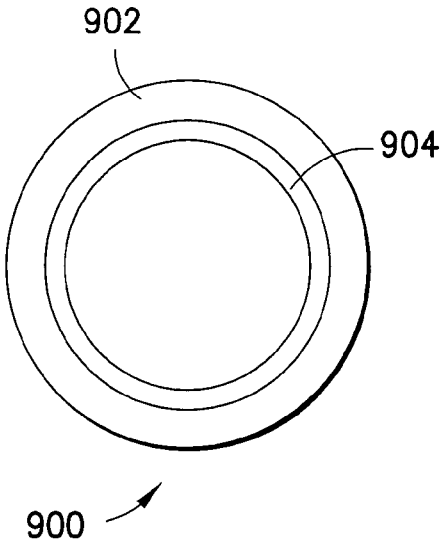

Embodiments of composite particle geometries are illustrated in FIGS. 3 through 9. As shown in FIG. 3, a composite particle (300) can be characterized by a core of low density material (304) (relative to the non-particle portion of the fluid (26) and the higher density material of the particle) surrounded by a shell of higher density magnetically responsive material (302) (relative to the non-particle portion of the fluid (26) and the lower density material of the particle). The lower density material need not be magnetically responsive, although it could be if a magnetically responsive material of suitable density is available. As shown in FIG. 4, a composite particle (400) may be characterized by a magnetically responsive rod or plate (402) coated with lower density material (404). This embodiment may also be characterized by an aspect ratio in one or two dimensions that is greater than unity. As shown in FIG. 5, a composite particle (500) may be characterized by a magnetically responsive material core ( 504) surrounded by a low density material shell (502). As shown in FIG. 6, a composite particle (600) may be characterized by a magnetically responsive material (602) that is partially coated with low density material (604), e.g., one side. As shown in FIG. 7, a composite particle (700) may be characterized by magnetically responsive material fibers (702) in a low density material matrix (704). For example, the low density material could be used as a binder to hold a plurality of magnetic rods or plates together. As shown in FIG. 8, a composite particle (800) may be characterized by at least one low density material member (804) attached to at least one magnetically responsive material member (802) at an outside surface. In the illustrated example, two magnetically responsive particles are attached on opposite sides of a low density particle. As shown in FIG. 9, a composite particle (900) may be characterized by a hollow core of low density material (904) surrounded by a magnetically responsive material shell (902). Other embodiments of composite particles, i.e., in which at least one distinct magnetically responsive member is attached to at least one distinct lower density member, will be apparent in view of the above embodiments.

Figure 10:
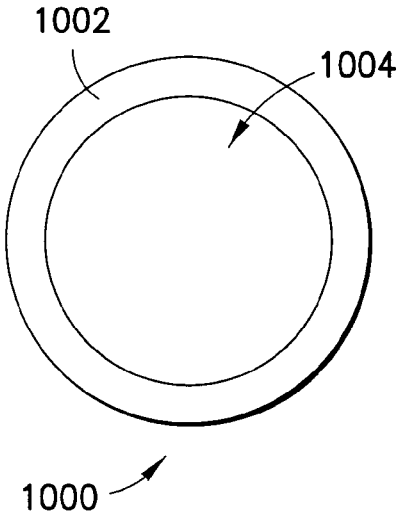
FIGS. 10 and 11 illustrate embodiments of shaped particle geometries.
Figure 11:
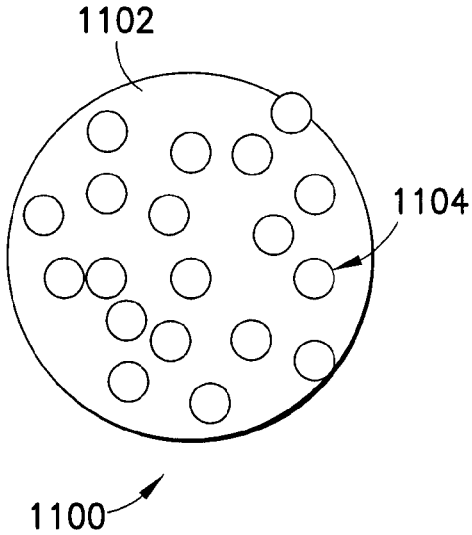

Embodiments of shaped particle geometries are illustrated in FIGS. 10 and 11. As shown in FIG. 10, a shaped particle (1000) can be characterized by a hollow shell of magnetically responsive material (1002). The inclusion (1004) may be empty, i.e., a vacuum, or filled with a fluid or gas. Alternatively, the inclusion may be in hydraulic communication with the base fluid so that it fills and still have lower specific gravity than a solid particle. As shown in FIG. 11, a shaped particle (1100) can alternatively be characterized by an internally porous magnetically responsive material (1102). The porous material has multiple inclusions (1104) which may be distinct, e.g., closed cell, or hydraulically connected with each other. Each inclusion may be empty or filled with a gas. Alternatively, even a porous material in hydraulic communication with the outside environment such that the inclusions fill with base fluid would have lower specific gravity than a solid particle. One method of creating inclusions is to create a composite particle which is chemically and/or thermally treated to remove one or more phases, e.g., wax that can be heated to melt and drain out of the magnetic particle. Other embodiments of shaped particles, i.e., in which at least one distinct magnetically responsive member has one or more inclusions, will be apparent in view of the above embodiments.

Embodiments of low density magnetically non-responsive particles could have any of various shapes and sizes, including but not limited to those described above. The specific gravity of the magnetorheological fluid can be reduced by mixing such low density particles with magnetically responsive particles, i.e., the low density particles would not assist in formation of chains, but would reduce specific gravity of the fluid.

Figure 12:
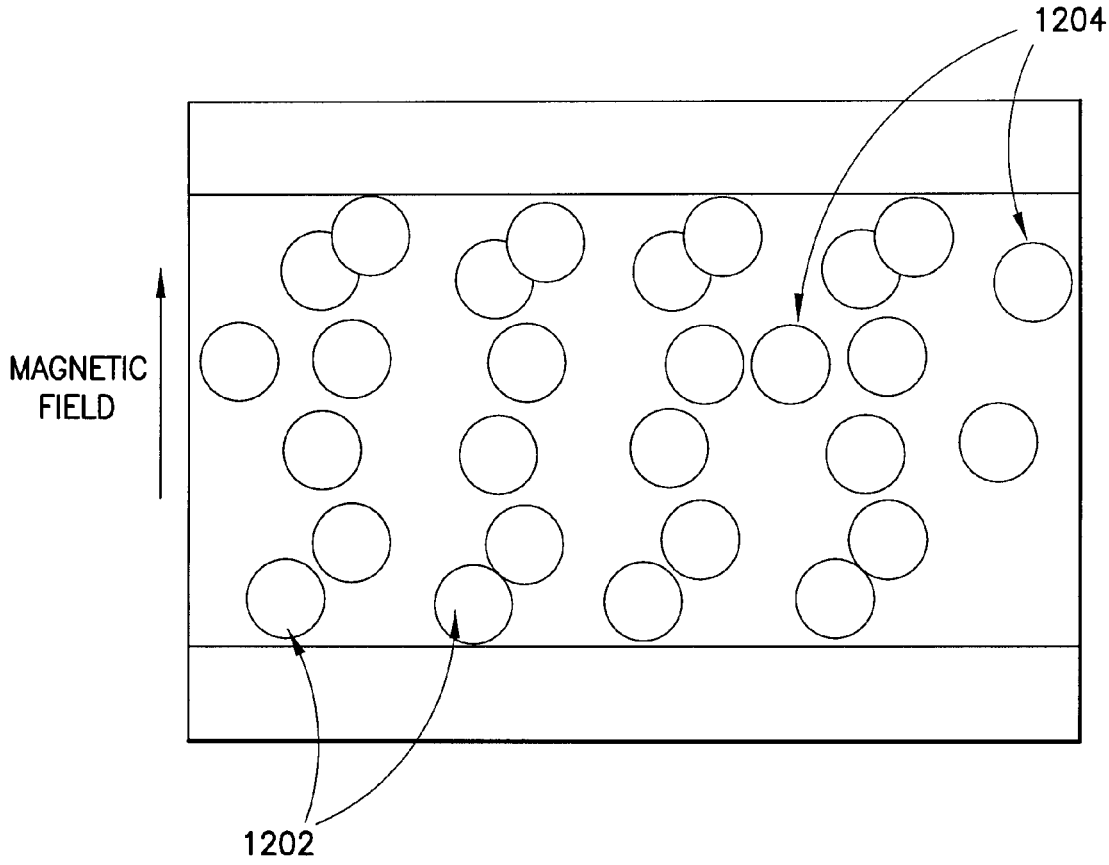
FIG. 12 illustrates a mixture of field-response and field non-responsive particles.

Referring to FIG. 12, particles such as those described above, either magnetically responsive, magnetically non-responsive, or both, may be constructed in different sizes and mixed, i.e., different sizes, types, embodiments, and combinations thereof. For example, field-responsive particles (1202) that form chains could be mixed with field non-responsive particles (1204) that do not form chains. Another example of a mixture could be:

100-300 μm particle size—55% particle volume fraction;
20-30 μm particle size—35% particle volume fraction; and
2-5 μm particle size—10% particle volume fraction,
where the particles are 60% of the fluid volume fraction. One or more of the particle size groups may be magnetically responsive, whereas the other group or groups may be magnetically non-responsive but function to reduce density and/or increase suspendability of the magnetically responsive particles.

Materials that may be used for the magnetically responsive phases of the magnetically responsive particles include: iron (ferrite), carbonyl iron, iron oxides (FeO, Fe2O3,Fe3O4), nickel, manganese, cobalt and alloys of those usually including iron. Materials that may be used for lower density phase of composite particles or magnetically non-responsive particles that are added to reduce fluid density include: polymers, polyAryletherketones (PEEK, PEK, PEEKK, PEKK), PTFE, FEP Teflon®, polyimides, polyamides, polyamideimides, PolyBenzImideazole (e.g. made by Celazole®), Self Reinforcing PolyPhenylene, PolyPhenylene Sulfide, Polysulfones (PSu (comm. name UDEL®), PES (comm. Name RADEL®), PPSu), TPI (PEI, PAI, PBI), Natural rubber, Buna-N (NBR), Hydrogenated Nitrile Rubber (HSN, HNBR), Silicone rubber, Flourosilicone rubber, Polyurethane, Buna-S (SBR), EPDM, Polyacrylate rubber, Floroelastomers, FKM (Viton®), FFKM (Kalrez®, Chemraz®), FEPM (Aflas®), Neoprene, Thermopolyurethane, Ethylene Vinyl Acetate, Butyl rubber, Cross-linked, blended and/or reinforced versions of polymers listed, Cement, Portland cement, Calcium aluminate cement, Calcium sulfoaluminate cement, Porous materials (e.g. porous metals, porous ceramics), Hollow spheres, Glass (e.g. 3M™ iM30K), Ceramic (e.g. 3M™ Ceramic Microspheres A-37), Cenosphere, Polymeric (e.g., Expanded Microspheres made by Lehmann & Voss & Co.®), Fibers or platelets, Aramide, Glass, Metals, Carbon, Silica, Alumina, Synthetic organic polymers (e.g. Dacron® Type 205NSO), Composite, Aggregates, perlite, expanded perlite, vermiculite, pumice, scoria, shales, clays, slates, slag, and Foam (may be stabilized with surfactants, e.g. air, nitrogen). The material phases, both magnetically responsive and non-responsive, can be composed of a continuous phase or agglomeration of multiple smaller particles to form the desired geometrical shape. Those skilled in the art will appreciate that electrorheological (ER) fluids operate similarly to magnetorheological fluids, although in the case of ER fluids the rheology of the fluid is modified using electrical fields. It will therefore be understood that the invention extends to ER fluids with particles responsive to electrical fields rather than magnetic fields.

Figure 13:
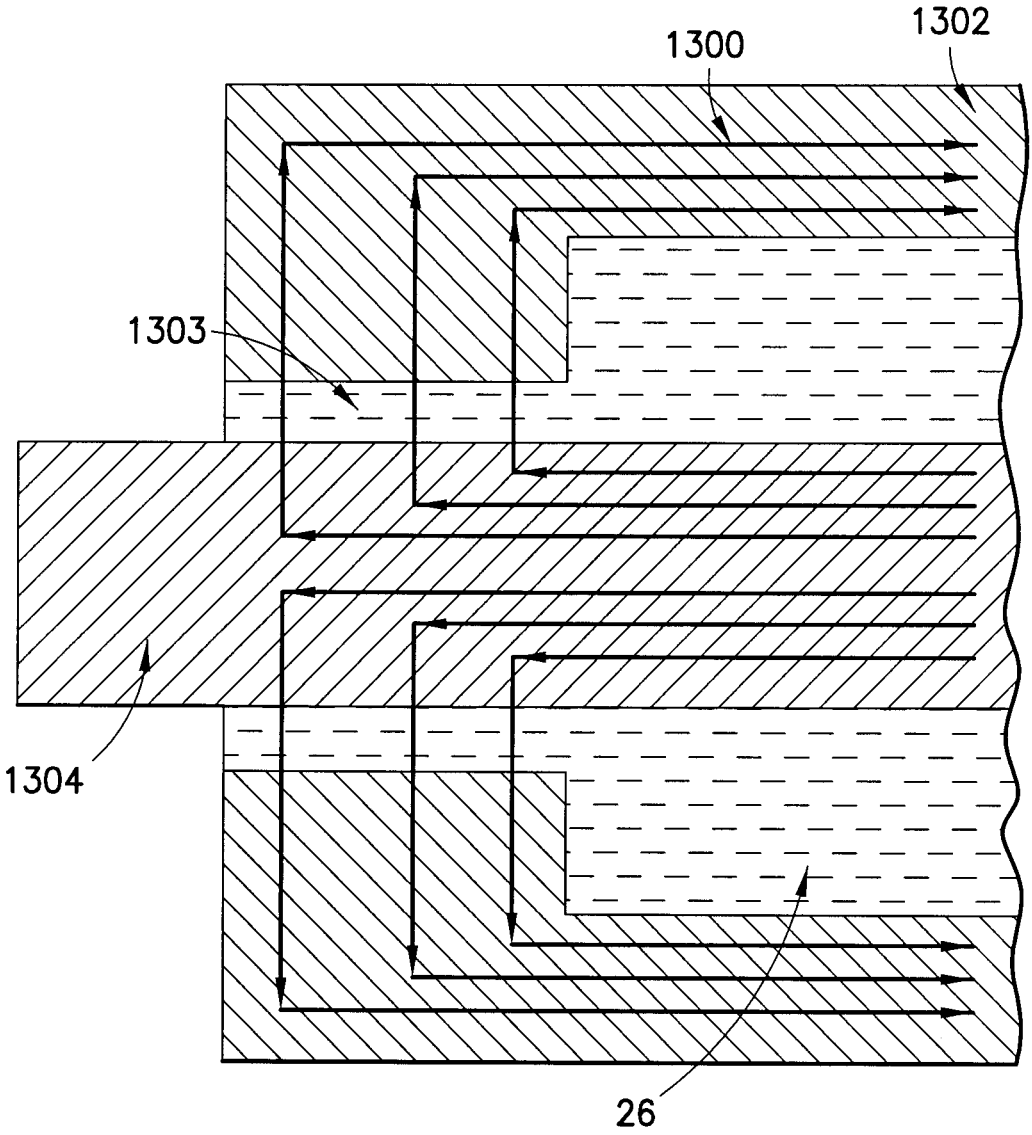
FIG. 13 illustrates a magnetorheological fluid shaft seal.
Figure 14:
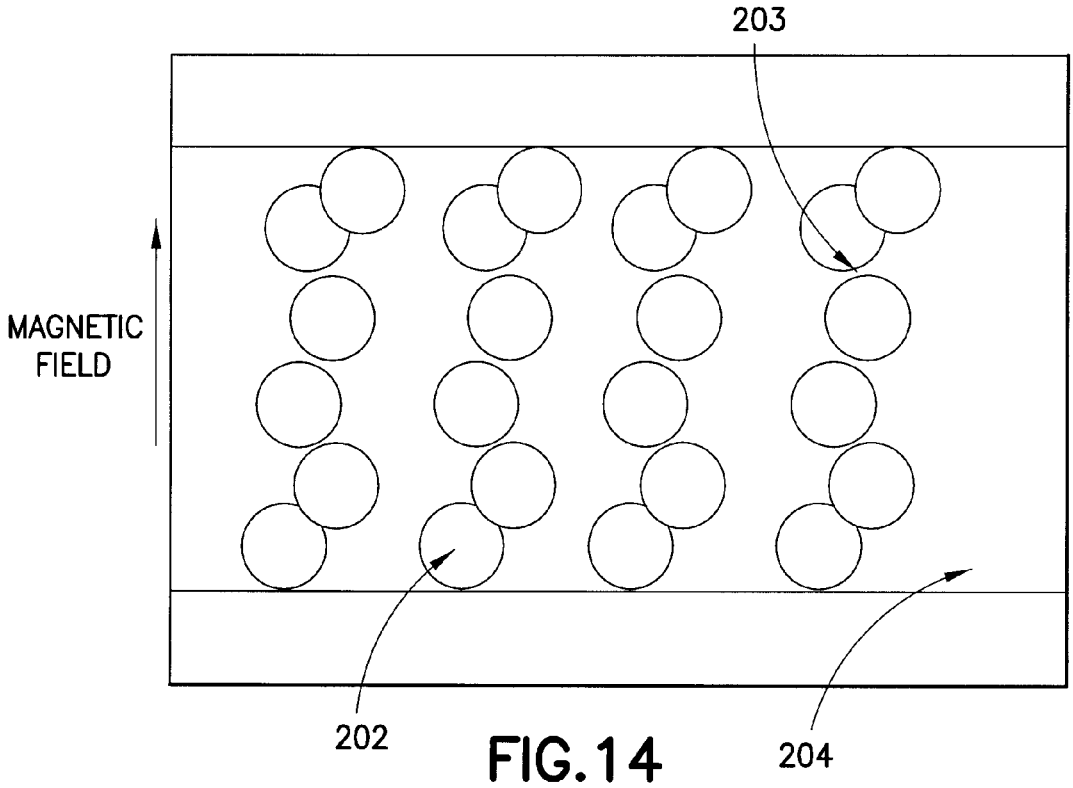
FIG. 14 illustrates fluid creep in a single phase base fluid.
Figure 15:
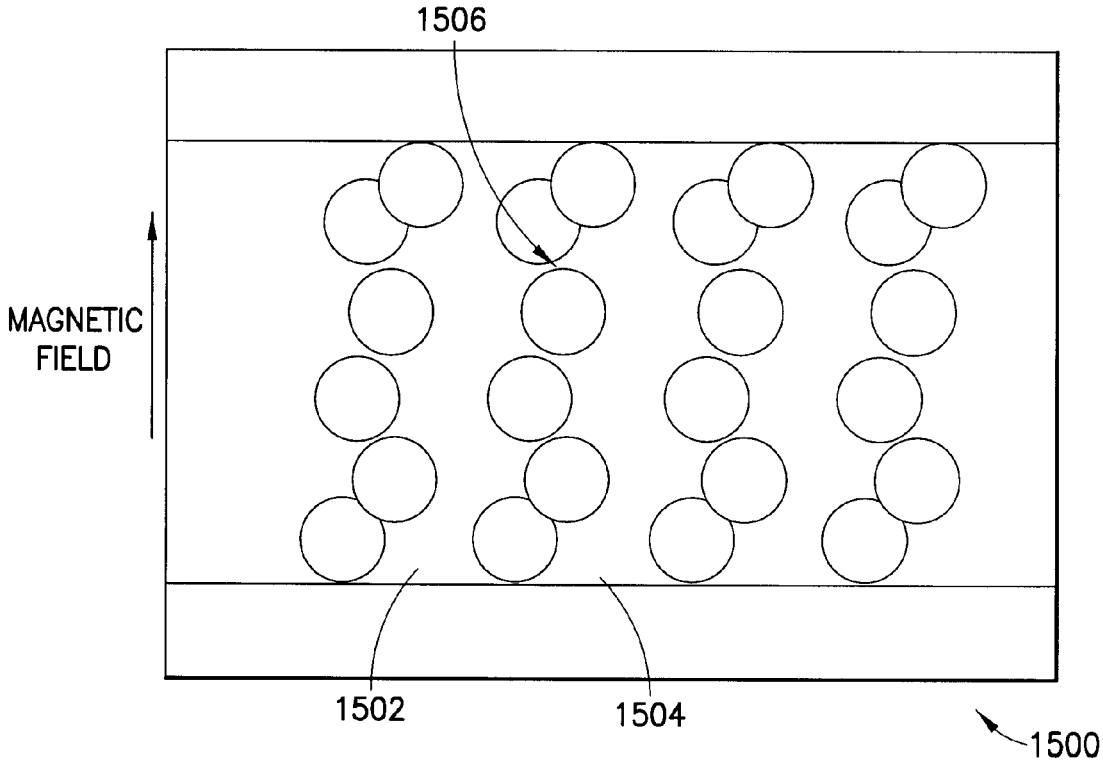
FIG. 15 illustrates resistance to fluid creep in a multi-phase base fluid.

Referring now to FIGS. 13 through 15, a modified magnetorheological fluid (26) may be used in cases where it is necessary or desirable to reduce fluid creep, e.g., a static or dynamic seal. FIG. 13 illustrates a magnetorheological fluid shaft seal. A magnetic field (1300) supplied between segments of a housing structure (1302) causes the fluid (26) to form a semi-solid seal (1303) in the gaps between the housing (1302) and shaft (1304). This seal (1303) functions whether or not the shaft is rotating, and also exhibits shear resistance which can counter differential pressure, i.e., pressure inside the housing versus pressure outside the housing. However, differential pressure tends to induce fluid creep (203) through the spaces between magnetically responsive particles (See FIG. 14). As shown in FIG. 15, the modification for mitigating fluid creep includes a multi-phase base fluid (1500). The multi-phase base fluid is a mixture of two or more substances (phases) (1502, 1504). At least two of these substances are immiscible, e.g., oil-water emulsion, foam. The surface tension (1506) between the boundaries of the immiscible substances in conjunction with the magnetically responsive particle chains tends to stop or retard creep flow. In particular, the different phases of the fluid separate upon activation of the fluid in the presence of a magnetic field. The separation tends to occur between adjacent chains/walls of magnetically responsive particles, resulting in a layering effect. The combination of relatively small gaps between particles in a wall/chain with surface tension at fluid boundaries retards or stops creep flow. Utilizing particles of interlocking shapes and mixtures of particles of different sizes, as already described above, can tend to reduce the size of the gaps between particles, and thus increase resistance to creep flow. The surface chemistry of the magnetorheological particles can be engineered such that the particles serve as interfacial stabilizers. These surface-modified particles may self-assemble at the fluid-fluid interface to reduce the interfacial tension. Techniques for synthesizing colloidosomes are described in A. D.

Dinsmore, Ming F. Hsu,1 M. G. Nikolaides, Manuel Marquez, A. R. Bausch, D. A. Weitz Colloidosomes: Selectively Permeable Capsules Composed of Colloidal Particles, Science 298, 1006 (2002); Paul F. Noble, Olivier J. Cayre, Rossitza G. Alargova, Orlin D. Velev, and Vesselin N. Paunov, Fabrication of "Hairy" Colloidosomes with Shells of Polymeric Microrods, Journal of the American Chemical Society 126, 8092 (2004), incorporated by reference. Fluid loss agents, which are typically used to control the loss of fluid to permeable formations in drilling fluids, cements, stimulation fluids and completion fluids could also be used to achieve the same or similar results.

As stated above, electrorheological (ER) fluids are analogous to magnetorheological fluids, and the concepts of the invention may be extended to ER fluids.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. Apparatus for causing a fluid to enter a semi-solid state in the presence of a magnetic field, comprising:

a plurality of energy field responsive particles which form chains in response to the magnetic field, the particles selected from the group consisting of:

particles in which at least one field-responsive member having a first density is attached to at least one member having a second density that is lower than the first density;

shaped particles in which at least one field-responsive member has one or more inclusions; and combinations thereof;

a multi-phase base fluid, the multi-phase base fluid mitigating fluid creep between the plurality of energy field responsive particles; and wherein the plurality of energy field responsive particles comprises, a 55% particle volume fraction of particles having particle sizes between 100-300 μm, a 35% particle volume fraction of particles having particle sizes between 20-30 μm , a 10% particle volume fraction of particles having particle sizes between 2-5 μm and wherein the plurality of energy field responsive particles are 60% of a volume fraction of the fluid, the particle sizes reducing a size of a gap between the plurality of energy field responsive particles and mitigating fluid creep.

2. The apparatus of claim 1 wherein the multi-phase base fluid comprises a mixture of at least two immiscible substances.

3. The apparatus of claim 1 wherein the plurality of energy field responsive particles includes a particle characterized by a core of material of the second density surrounded by a shell of field-responsive material of the first density.

4. The apparatus of claim 1 wherein the plurality of energy field responsive particles includes a particle characterized by a field-responsive rod or plate coated with a second density material.

5. The apparatus of claim 1 wherein the plurality of energy field responsive particles includes a particle characterized by a field-responsive material core surrounded by a second density material shell.

6. The apparatus of claim 1 wherein the plurality of energy field responsive particles includes a particle characterized by a field-responsive material that is partially coated with a second density material.

7. The apparatus of claim 1 wherein the plurality of energy field responsive particles includes a particle characterized by field-responsive material fibers in a second density material matrix.

8. The apparatus of claim 1 wherein the plurality of energy field responsive particles includes a particle characterized by at least one second density material member attached to at least one field-responsive material member at an outside surface.

9. The apparatus of claim 1 wherein the plurality of energy field responsive particles includes a particle characterized by a hollow core of a second density material surrounded by a field-responsive material shell.

10. The apparatus of claim 1 wherein the plurality of energy field responsive particles includes a shaped particle characterized by a hollow shell of field-responsive material.

11. The apparatus of claim 10 wherein the hollow shell of field-responsive material encloses an empty inclusion.

12. The apparatus of claim 1 wherein the plurality of energy field responsive particles includes a shaped particle characterized by a porous field-responsive material.

13. The apparatus of claim 11 wherein inclusions of the particle are hydraulically isolated from the fluid.

14. The apparatus of claim 1 wherein the plurality of energy field responsive particles includes a mixture of particles of differing shape.

15. A method for causing a fluid to enter a semi-solid state in a container in the presence of an energy field, comprising:

introducing a plurality of energy field responsive particles which form chains in response to the energy field, the particles selected from the group including:

particles in which at least one field-responsive member having a first density is attached to at least one member having a second density that is lower than the first density;

shaped particles in which at least one field- responsive member has one or more inclusions; and combinations thereof;

the plurality of energy field responsive particles comprising a 55% particle volume fraction of particles having particle sizes between 100-300 μm, a 35% particle volume fraction of particles having particle sizes between 20-30 μm, a 10% particle volume fraction of particles having particle sizes between 2-5 μm and wherein the plurality of energy field responsive particles are 60% of a volume fraction of the fluid;

introducing a multi-phase base fluid, and creating an energy field proximate to the particles, wherein the energy field is a magnetic energy field.

16. The method of claim 15 wherein the multi-phase base fluid comprises a mixture of at least two immiscible substances.

17. The method of claim 15 wherein the plurality of energy field responsive particles includes a particle characterized by a core of material of the second density surrounded by a shell of field-responsive material of the second density.

18. The method of claim 15 wherein the plurality of energy field responsive particles includes a particle characterized by a field-responsive rod or plate coated with second density material.

19. The method of claim 15 wherein the plurality of energy field responsive particles includes a particle characterized by a field-responsive material core surrounded by a second density material shell.

20. The method of claim 15 wherein the plurality of energy field responsive particles includes a particle characterized by a field-responsive material that is partially coated with second density material.

21. The method of claim 15 wherein the plurality of energy field responsive particles includes a particle characterized by field-responsive material fibers in a second density material matrix.

22. The method of claim 15 wherein the plurality of energy field responsive particles includes a particle characterized by at least one second density material member attached to at least one field-responsive material member at an outside surface.

23. The method of claim 15 wherein the plurality of energy field responsive particles includes a particle characterized by a hollow core of second density material surrounded by a field-responsive material shell.

24. The method of claim 15 wherein the plurality of energy field responsive particles includes a shaped particle characterized by a hollow shell of field-responsive material.

25. The method of claim 24 wherein the plurality of energy field responsive particles includes a shaped particle characterized by an empty inclusion.

26. The method of claim 15 wherein the plurality of energy field responsive particles includes a shaped particle characterized by a porous field-responsive material.

27. The method of claim 26 wherein the plurality of energy field responsive particles includes a shaped particle characterized by inclusions which are hydraulically isolated from the fluid.

28. The method of claim 15 wherein the plurality of energy field responsive particles includes a mixture of particles of differing shape.

29. The method of claim 15 further including introducing a fluid loss agent.

* * * * *